US007820614B2

(12) United States Patent
Tee, Jr. et al.

(10) Patent No.: US 7,820,614 B2
(45) Date of Patent: Oct. 26, 2010

(54) MULTIPLE USE FABRIC SOFTENING COMPOSITION WITH REDUCED LINTING

(75) Inventors: Johannson Jimmy Tee, Jr., West Chester, OH (US); Jeffrey Frank Omnitz, Cincinnati, OH (US); Alessandro Corona, III, Mason, OH (US); Hugo Jean Marie Demeyere, Merchtem (BE); David Edward Whittlinger, Janesville, WI (US); Saji Chacko Meledathu, Wilmette, IL (US); Dennis Arch Parrish, Sandston, VA (US)

(73) Assignee: The Procter & Gamble Company, Cincinnati, OH (US)

( * ) Notice: Subject to any disclaimer, the term of this patent is extended or adjusted under 35 U.S.C. 154(b) by 243 days.

(21) Appl. No.: 11/496,159

(22) Filed: Jul. 31, 2006

(65) Prior Publication Data

US 2007/0066509 A1 Mar. 22, 2007

Related U.S. Application Data

(60) Provisional application No. 60/719,442, filed on Sep. 22, 2005.

(51) Int. Cl.
*C11D 1/835* (2006.01)

(52) U.S. Cl. ..... 510/519; 510/501

(58) Field of Classification Search ..... 510/501, 510/519

See application file for complete search history.

(56) References Cited

U.S. PATENT DOCUMENTS

| | | | | |
|---|---|---|---|---|
| 3,442,692 | A | 5/1969 | Gaiser | |
| 3,676,199 | A | 7/1972 | Hewitt et al. | |
| 3,686,025 | A | 8/1972 | Morton | |
| 4,049,858 | A * | 9/1977 | Murphy | 510/520 |
| 5,480,567 | A * | 1/1996 | Lam et al. | 510/519 |
| 5,643,865 | A * | 7/1997 | Mermelstein et al. | 510/521 |
| 7,087,572 | B2 * | 8/2006 | Hubig et al. | 510/501 |
| 7,553,808 | B2 | 6/2009 | Johannson et al. | |
| 2003/0192197 | A1 | 10/2003 | Griese et al. | |
| 2003/0195130 | A1 * | 10/2003 | Lentsch et al. | 510/327 |
| 2007/0066510 | A1 | 3/2007 | Johannson et al. | |

FOREIGN PATENT DOCUMENTS

| | | |
|---|---|---|
| WO | WO 2005/085404 | 9/2005 |
| WO | WO 2005/085514 | 9/2005 |
| WO | WO 2007/034450 A3 | 8/2007 |

OTHER PUBLICATIONS

PCT International Search Report, dated mailed: Apr. 4, 2007 57 pages.

Office Action for U.S. Appl. No. 11/525,302, date mailed Oct. 23, 2008.

Office Action for U.S. Appl. No. 11/525,302, date mailed Mar. 20, 2009.

Office Action for U.S. Appl. No. 11/526,042 date mailed Oct. 24, 2008.

Notice of Allowance and Fees Due for U.S. Appl. No. 11/526,042, date mailed Apr. 17, 2009.

* cited by examiner

*Primary Examiner*—John R Hardee
(74) *Attorney, Agent, or Firm*—Mark A. Charles; David V. Upite; Gary J. Foose

(57) ABSTRACT

An article comprising a multiple use fabric conditioning composition that is operably connectable to the inside of a dryer is useful for softening fabric without staining the fabric and with reduced linting.

24 Claims, No Drawings

MULTIPLE USE FABRIC SOFTENING COMPOSITION WITH REDUCED LINTING

CROSS REFERENCE TO RELATED APPLICATION

This application claims the benefit of U.S. Provisional Application No. 60/719,442, filed Sep. 22, 2005.

FIELD OF THE INVENTION

The present invention is directed to multiple use, dryer-added, fabric softening compositions.

BACKGROUND OF THE INVENTION

Dryer-added fabric softening products provide a convenient way for a consumer to provide fabric conditioning benefits to laundry.

Generally, there are two main types of dryer-added fabric softening products, namely, single use products and multiple-use products. Single use products, most commonly in the sheet form coated with a fabric softening composition, call for adding a single sheet into an automatic clothes dryer containing a wet laundry load, at the beginning of the drying cycle. Examples of these types of products are disclosed in U.S. Pat. Nos. 3,442,692 and 3,686,025.

Multiple use fabric softening products are placed in the interior of the dryer to release the fabric conditioning component to successive laundry loads. Each multiple-use product lasts many drying cycles and thus provides a better convenience to the consumer than a single use product. Examples of multiple-use products include those described in U.S. Pat. No. 3,676,199 and US 2003/0192197 A1.

A problem facing such multiple use products, particularly those products having uses over 20, or 30, or more cycles, is the potential for lint deposition on the multiple use product. This lint deposition prevents the multiple use product from releasing fabric conditioning compositions. The lint deposition is also unattractive to the consumer.

There is a need to provide a multiple use fabric softening product that minimizing lint deposition, yet provides effective fabric softening and/or freshening benefits throughout the course of the product life span.

SUMMARY OF THE INVENTION

The present invention attempts to solve these and other problems by providing, in one aspect of the present invention, a multiple use, dryer added, article comprising a fabric softening composition, wherein the composition comprises a fabric softening active, wherein the fabric softening active consists essentially of an ester quaternary ammonium compound substantially free or free of any other quaternary ammonium compound, preferably substantially free or free of any other quaternary ammonium compound and wherein the fabric softening composition has a viscosity of between about 850 cps to about 7500 cps.

Another aspect of the invention provides for a method of softening a fabric comprising the step of contacting the fabric with an article of the present invention in an automatic laundry dryer.

Another aspect of the invention provides for a kit comprising a composition of the present invention, wherein the article is operably connectable to an inside surface of a dryer.

Another aspect of the invention provides for a kit comprising an article according to the present invention.

DETAILED DESCRIPTION OF THE INVENTION

Definitions:

"Fabric" refers to any textile or fabric material that is laundered, e.g., garment.

"Multiple use," means the fabric softening article may be used to deliver a desired amount of a fabric softening active to fabric during at least two cycles for drying laundry in an automatic laundry dryer, preferably at least about 10 cycles, more preferably at least about 20 cycles, even more preferably at least about 30 cycles, yet more preferably at least about 40 cycles, alternatively at least about 50 cycles, alternatively at least about 60 cycles, before the fabric conditioning composition needs to be replaced. In one embodiment, the term "multiple use" is not greater than 200 cycles, alternatively not greater than 100 cycles.

"Operably connectable to an inside surface of a dryer" is used herein in the broadest sense to include any means of attaching the article of the present invention to the inside surface of an automatic laundry dryer. The inside surface of the dryer may include the barrel, baffle or inside of the door of the dryer. The means attaching may include an adhesive that can be used to releasably affix the composition and composition carrier to the inside surface of a dryer. Alternatively, the means of attaching the article may also include a docking member such as one described in U.S. Pat. Pub. 2003/0192197 A1 published Oct. 16, 2003.

"Perfume" is used to indicate any odoriferous material. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Non-limiting examples of different perfume compositions are given in US.2003/0104969 A1; U.S. Pat. Nos. 5,714,137; 6,048,830. In one embodiment of the invention, the composition comprises at least 2.0%, alternatively, at least about 2.5%, alternatively at least about 3%, alternatively at least about 4% perfume by weight of the fabric softening composition.

"Wax" is used herein in the broadest sense to include any wax that is suitable for use in an automatic laundry dryer and has a melting point that can be above about 90° C., alternatively above about 95° C., alternatively above about 100° C., or above about 110° C., or above about 120° C. The melting temperature of the wax can be below 200° C., below about 180° C., or below about 170° C. The wax may comprise from about 5% to about 65%, alternatively about 10% to about 50%, alternatively from about 15% to about 45%, alternatively from about 41% to about 45%, by weight of the fabric softening composition. Suitable non-limiting examples of a wax for purposes of the present invention comprises at least one of the following: ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. In one embodiment, the wax is chosen from ethylenebisteramide, ethylenebisoleamide, ethylenebisbehenamide, and mixtures thereof. In another embodiment, the wax comprises ethylene bisstearamide. In yet another embodiment, the wax is one selected from US 2003-0195130 A1 from paragraphs 18-23. Suitable waxes may be commercially available from Lonza such those under name of ACRAWAX C. In one embodiment, the fabric softening composition is a solid at 22° C.

Without wishing to be bound by theory, it is believed that the viscosity and Iodine Values discovered in the present invention produce an article that is sufficiently hard enough to prevent lint from attaching to the article's surface while being soft enough to allow the fabric softener composition to release from the article. These values were unexpectedly found as a solution to controlling the article's hardness to prevent staining was sought.

Composition

One aspect of the present invention provides for a fabric softening composition comprises a fabric softening active consisting essentially of an ester quaternary ammonium compound. In one embodiment, the fabric softening active is substantially free or free of any other quaternary ammonium compound but for the ester quaternary ammonium compound. In yet still another embodiment, the fabric softening active is substantially free or free of any other actives but for the ester quaternary ammonium compound.

The present invention is based, in part, upon the surprising discovery that fabric softening compositions that comprise an ester quaternary ammonium free of other quaternary ammonium compounds, such a diamidoamine quaternary ammonium compounds (e.g., Varisoft®) have less fabric staining (if at all) in the dryer, particularly fabric that is black, as compared to those fabric softening compositions outside the scope of the present invention. Examples of quaternary ammonium compounds are described in US 2003/0195130 A1 at paragraphs 14 to 17.

In one embodiment, the ester quaternary ammonium compound is one comprising the formula:

$$\{(R^1)_{4-m}—N+—[(CH_2)_n—Y—R^2]_m\}X^-$$

wherein each $R^1$ substituent is either hydrogen, a short chain $C_1$-$C_6$, preferably $C_1$-$C_3$ alkyl or hydroxyalkyl group, e.g., methyl (most preferred), ethyl, propyl, hydroxyethyl, and the like, poly ($C_{2-3}$ alkoxy), preferably polyethoxy, group, benzyl, or mixtures thereof; each m is 2 or 3; each n is from 1 to about 4, preferably 2; each Y is —O—(O)C—, or —C(O)—O—, and it is acceptable for each Y to be the same or different; the sum of carbons in each $R^2$, plus one when Y is —O—(O)C—, is $C_{12}$-$C_{22}$, preferably $C_{14}$-$C_{20}$, with each $R^2$ being a hydrocarbyl, or substituted hydrocarbyl group; it is acceptable for $R^2$ to be unsaturated or saturated and branched or linear and preferably it is linear; it is acceptable for each $R^2$ to be the same or different and preferably these are the same; and $X^-$ can be any softener-compatible anion, preferably, chloride, bromide, methylsulfate, ethylsulfate, sulfate, phosphate, and nitrate, more preferably chloride or methyl sulfate. Preferred ester quaternary ammonium compounds are typically made by reacting alkanolamines such as MDEA (methyldiethanolamine) and TEA (triethanolamine) with fatty acids. Some materials that typically result from such reactions include N,N-di(acyl-oxyethyl)-N,N-dimethylammonium chloride or N,N-di(acyl-oxyethyl)-N,N-methylhydroxyethylammonium methylsulfate wherein the acyl group is derived from animal fats, unsaturated, and polyunsaturated, fatty acids, e.g., tallow, hardended tallow, oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, palm oil, etc. Non-limiting examples of suitable fatty acids are listed in U.S. Pat. No. 5,759,990 at column 4, lines 45-66. In another embodiment, the fabric softening active consists essentially of an ester quaternary ammonium compound. In yet another embodiment, the fabric softening active is substantially free or free of any other active but for the ester quaternary ammonium compound.

For the unsaturated alkyl group, the Iodine Value of the parent fatty acid of this $R^2$ group is from about 1 to about 30, in another embodiment from about 1 to about 20 (As used herein, the "branched alkyl" groups include those that contain a substituent that is hydrophobic, even though they are attached to the main chain by bonds that are not carbon to carbon, e.g., by oxygen, as in the alkoxy substituents, and the Iodine Value of a "parent" fatty acid, or "corresponding" fatty acid, is used to define a level of unsaturation for an R1 groups that is the same as the level of unsaturation that would be present in a fatty acid containing the same $R^2$ group. When an individual $R^2$ is both branched and unsaturated, it is treated as if it is branched.)

In one embodiment, the fabric softening composition comprises from about 33% to about 62%, alternatively from about 45% to about 60%, alternatively from about 49% to about 57%, by weight of the composition.

In one embodiment, the fabric softening composition comprises a viscosity from about 850 cps (centipoise) to about 7500 cps, alternatively from about 1200 cps to about 1500 cps at 160° F. In another embodiment, the fabric softening composition comprises a viscosity from about 450 cps to about 2150 cps, alternatively from about 650 cps to about 850 cps at 180° F.

In one embodiment, the fabric softening composition has less than about 10% builder, in an alternate embodiment less than about 5% builder, in an alternate embodiment, less than about 3% builder, in an alternate embodiment less than about 1% builder, in one embodiment less than about 0.1% builder. Builders include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing. A non-limiting group of builders is disclosed in U.S. Pat. No. 6,559,113 to Jeffery.

In one embodiment, the fabric softening composition has less than about 10% surfactant, in an alternate embodiment less than about 5% surfactant, in an alternate embodiment, less than about 3% surfactant, in an alternate embodiment less than about 1% surfactant, in one embodiment less than about 0.1% surfactant. Surfactants of the present invention include anionic, cationic, nonionic ampholytic, amphoteric and zwitterionic surfactants and mixtures thereof. A non-limiting group of surfactants is disclosed in U.S. Pat. No. 6,559,113 to Jeffery.

Method of Making

One aspect of the invention provides for making a fabric softening composition of the present invention providing the steps of mixing the components of the composition, including the wax additives of the present invention, at a temperature sufficient to melt all the components. The step of mixing preferably takes place at a temperature in excess of about 100° C. In general, the components should not be mixed at a temperature that is so high that it harms or discolors the components of the composition. For many components of the fabric softening composition, the mixing temperature can be less that about 180° C. Further steps to make the compositions of the present invention may include those described in US 2003/0195130 A1, paragraphs 25 to 26.

Kit

Another aspect of the present invention provides a kit, wherein the kit comprises a composition of the present invention. In one embodiment, the kit further comprises instructions instructing the use to place an article, comprising a composition of the present invention, to an inside surface of the dryer. In one embodiment, the kit comprising an article, wherein the article comprises a composition according to the present invention; but wherein the article is free of a perforated membrane for exuding the composition through the perforation on to the surface of the article. An example of such a "perforated membrane" excluded from the scope of at least one embodiment of the invention is one described at U.S. Pat. No. 4,014,432. In another embodiment, the kit comprises an article, wherein the article comprises a composition of the present invention and is operably connectable to an inside surface of a dryer. The kit may optionally comprise instructions instructing the user to operably connect the article to the inside surface of the dryer.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

Except as otherwise noted, the articles "a," "an," and "the" mean "one or more."

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiple use, dryer added, article comprising a fabric softening composition, wherein the fabric softening composition comprises a fabric softening active and a wax;

wherein the fabric softening active of comprises an ester quaternary ammonium compound;

wherein the article is operably connectable to an inside surface of a dryer; and wherein the fabric softening composition has an Iodine Value of about 1; and wherein the wax comprises an ethylene bisamide; and wherein the wax comprises from about 50% to about 65% by weight of the fabric softening composition.

2. The article of claim 1 wherein the ester quaternary ammonium compound has an Iodine Value of 1.

3. The article of claim 1, wherein the ester quaternary ammonium compound comprises from about 33% to about 62% by weight of the fabric softening composition.

4. The article of claim 3, wherein the ester quaternary ammonium compound comprises from about 49% to about 57% by weight of the fabric softening composition.

5. The article of claim 4, wherein the wax is chosen from ethylenebisteramide, ethylenebisoleamide, ethylenebisbehenamide, and mixtures thereof.

6. The article of claim 5 wherein the wax comprises about 50% by weight of the fabric softening composition.

7. The article of claim 1, where the composition further comprises from about 1% to about 4% of a perfume, by weight of the fabric softening composition.

8. The article of claim 7, wherein the article is free of a perforated membrane.

9. The article of claim 1, wherein the ester quaternary ammonium compound comprises from about 45% to about 60% by weight of the fabric softening composition and has an Iodine Value of 1.

10. The article of claim 9, wherein the ester quaternary ammonium compound comprises from about 49% to about 57% by weight of the fabric softening composition.

11. The article of claim 10, wherein the wax comprises about 50% by weight of the fabric softening composition.

12. The article of claim 1, wherein the article is free of a perforated membrane.

13. The article of claim 1, wherein the fabric softening active consists essentially of an ester quaternary ammonium compound.

14. The article of claim 1, wherein the ester quaternary ammonium compound comprises a viscosity from about 1,200 to 1,500 cps at 160° F.

15. The article of claim 4, wherein the ester quaternary ammonium compound comprises a viscosity from about 650 cps to about 850 cps at 180° F.

16. The article of claim 15, wherein the fabric softening active consists essentially of the ester quaternary ammonium compound.

17. The article of claim 1, wherein the ester quaternary ammonium compound comprises a viscosity from about 650 cps to about 850 cps at 180° F.

18. The article of claim 1, wherein the wax comprises about 50% by weight of the fabric softening composition.

19. The article of claim 18, wherein the ester quaternary ammonium compound comprises from about 33% to about 49% by weight of the fabric softening composition.

20. The article of claim 1, wherein the wax comprises about 50% by weight of the fabric softening composition, wherein the ester quaternary ammonium compound comprises from about 33% to about 49% by weight of the fabric softening composition, wherein the wax comprises an ethylene bisamide.

21. The article of claim 20, where the composition further comprises from about 1% to about 4% of a perfume, by weight of the fabric softening composition.

22. The article of claim 1, wherein the wax comprises an ethylene bisteramide.

23. The article of claim 1, wherein the wax is chosen from ethylenebisteramide, ethylenebisoleamide, ethylenebisbehenamide, and mixtures thereof.

24. The article of claim 1, wherein the ester quaternary ammonium compound comprises from about 33% to about 49% by weight of the fabric softening composition.

* * * * *